US005114299A

United States Patent [19]

Roche et al.

[11] Patent Number: 5,114,299

[45] Date of Patent: May 19, 1992

[54] ATTACHMENT FOR A PRIME MOVER

[76] Inventors: Thomas Roche; James Roche, both of Gurteen, Ballinasloe, County Galway, Ireland

[21] Appl. No.: 670,482

[22] Filed: Mar. 15, 1991

Related U.S. Application Data

[63] Continuation of Ser. No. 390,547, Aug. 8, 1989, abandoned.

[51] Int. Cl.[5] ..... E02F 9/00

[52] U.S. Cl. ..... 414/722; 414/724; 414/912; 414/732; 37/DIG. 3

[58] Field of Search ..... 414/723, 724, 725, 912, 414/607, 722, 729, 732; 172/825; 37/117.5, DIG. 3

[56] References Cited

U.S. PATENT DOCUMENTS

| | | | |
|---|---|---|---|
| 2,924,345 | 2/1960 | Bodin | 37/117.5 X |
| 2,932,101 | 4/1960 | Ludowici | 37/117.5 X |
| 3,077,999 | 2/1963 | Svoboda | 37/117.5 X |
| 4,403,906 | 9/1983 | Holopainen | 414/912 X |
| 4,787,811 | 11/1988 | Langenfeld et al. | 414/723 |
| 4,863,338 | 9/1989 | Johnson | 414/724 X |

FOREIGN PATENT DOCUMENTS

| | | | |
|---|---|---|---|
| 1164819 | 6/1984 | Canada | 414/724 |
| 35440 | 7/1971 | Ireland . | |

*Primary Examiner*—David A. Bucci
*Assistant Examiner*—Ronald W. Underwood
*Attorney, Agent, or Firm*—Pollock, VandeSande & Priddy

[57] ABSTRACT

A versatile attachment for a prime mover includes a loading bucket for material handling and a grapple for manipulating elongate elements. The loading bucket is pivotally attached to a support frame by a large pivot pin. The grapple includes two fixed grapple fingers and a movable finger. The bucket may slew relative to the frame up to 110°.

5 Claims, 8 Drawing Sheets

ATTACHMENT FOR A PRIME MOVER

This application is a continuation of Ser. No. 07/390,547, filed on Aug. 8, 1989, abandoned.

FIELD OF THE INVENTION

The present invention relates to a multi-purpose attachment for a prime mover.

DESCRIPTION OF THE PRIOR ART

Prime movers such as hydraulic excavator jibs or loader arms, agricultural tractors with loader arms, skidsteer loaders, trucks, fork lifts, and the like, are usually fitted with an attachment which may be used for a particular purpose. If the prime mover is then required for a different purpose, it is necessary to change the attachment, by removing the original attachment and then securing the required attachment to the prime mover. This changing of the attachment can take a considerable amount of time and labor. It is an object of the present invention to alleviate the above disadvantage.

SUMMARY OF THE INVENTION

The present invention provides an attachment for a prime mover, the attachment comprising a loading bucket and a grappling apparatus, whereby the loading bucket may be used for material handling and the grappling apparatus may be used for handling elongate elements such as poles, tools and the like.

Advantageously, the attachment includes a support frame to which the loading bucket is pivotally mounted by pivot means.

Preferably, the pivot means comprises a rotatable shaft and hydraulic ram means for pivotting the bucket relative to the support frame about the shaft.

In the preferred embodiment, the grappling apparatus comprises at least one fixed member located within the loading bucket and at least one movable member which is operable by hydraulic ram means.

Advantageously, a support for an elongate element is provided at each end of the loading bucket and the grappling apparatus is provided intermediate these ends.

In the preferred embodiment, the attachment includes quick coupling means which enables the attachment to be connected and disconnected to a prime mover.

BRIEF DESCRIPTION OF THE DRAWINGS

The invention will hereinafter be more particularly described with reference to the accompanying drawings which show, by way of example only, one embodiment of an attachment for a prime mover according to the invention. In the drawings.

DETAILED DESCRIPTION OF PREFERRED EMBODIMENT

Figure 1:
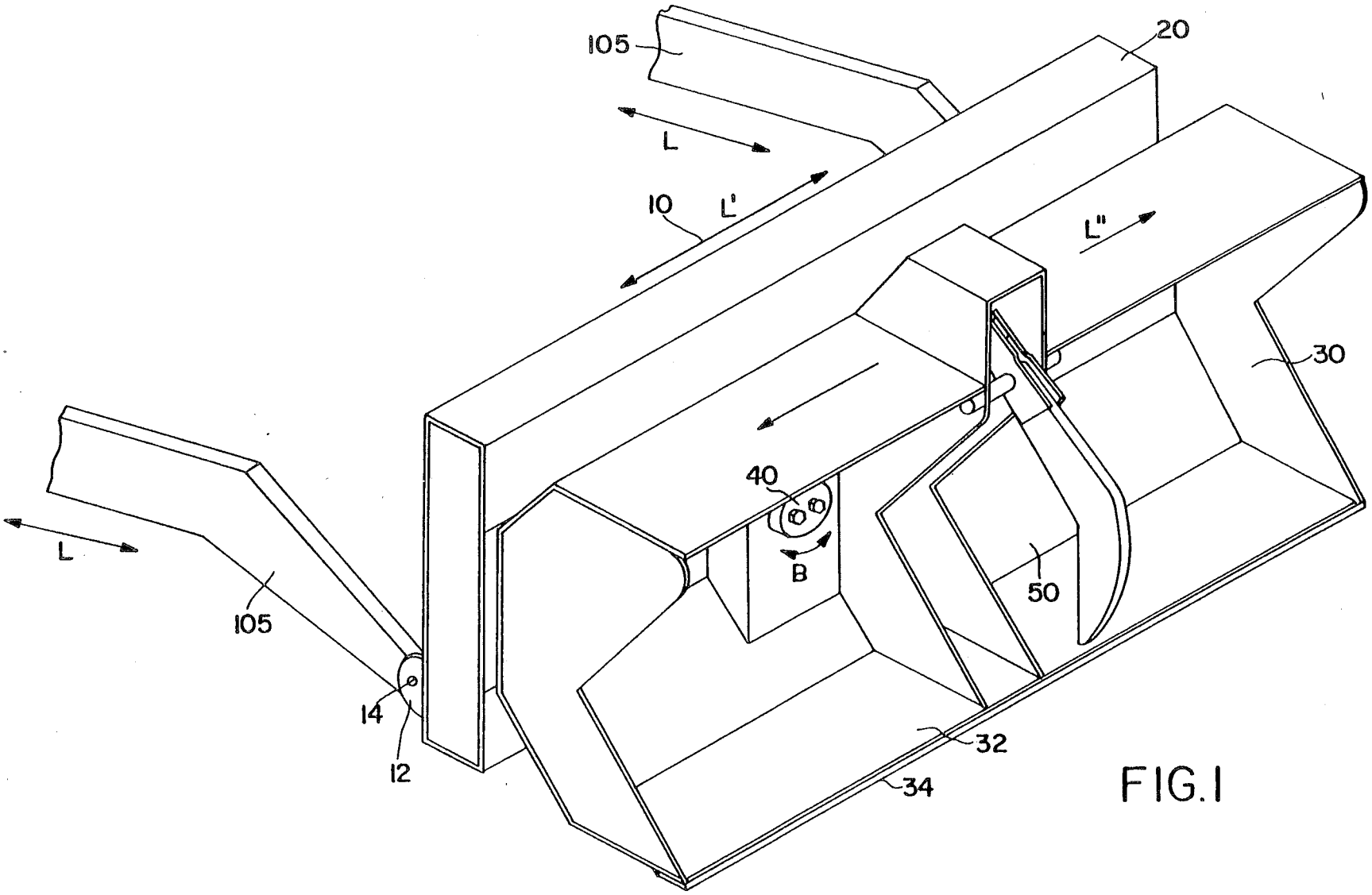
FIG. 1 is a perspective view of the attachment in a first mode, secured to loader arms of a prime mover.

Referring to the drawings, and initially to FIG. 1, the attachment 10 is shown attached to arms 105 of a prime mover (not shown). Each arm 105 has a longitudinal axis L. Each arm 105 is connected to a mounting bracket 12 by a pivot pin 14. The mounting brackets 12 (only one of which is shown) are provided at the rear of a mounting frame 20 having a longitudinal axis L'. A bucket 30 is pivotally attached to the mounting frame 20 by a single large pivot pin 40. The bucket 30 has a longitudinal axis L''.

As shown in FIG. 1, the bucket 30 has a lower lip 32 which extends to a strengthened edge 34. In the working mode as shown, the bucket 30 functions as a materials handling bucket for handling materials such as sand or soil. The bucket 30 can be tipped sideways as shown by B about the axis P of the pivot pin 40 or the bucket 30 and frame 20 can be tipped forward about the axis of the pivot pins 14.

Figure 2:
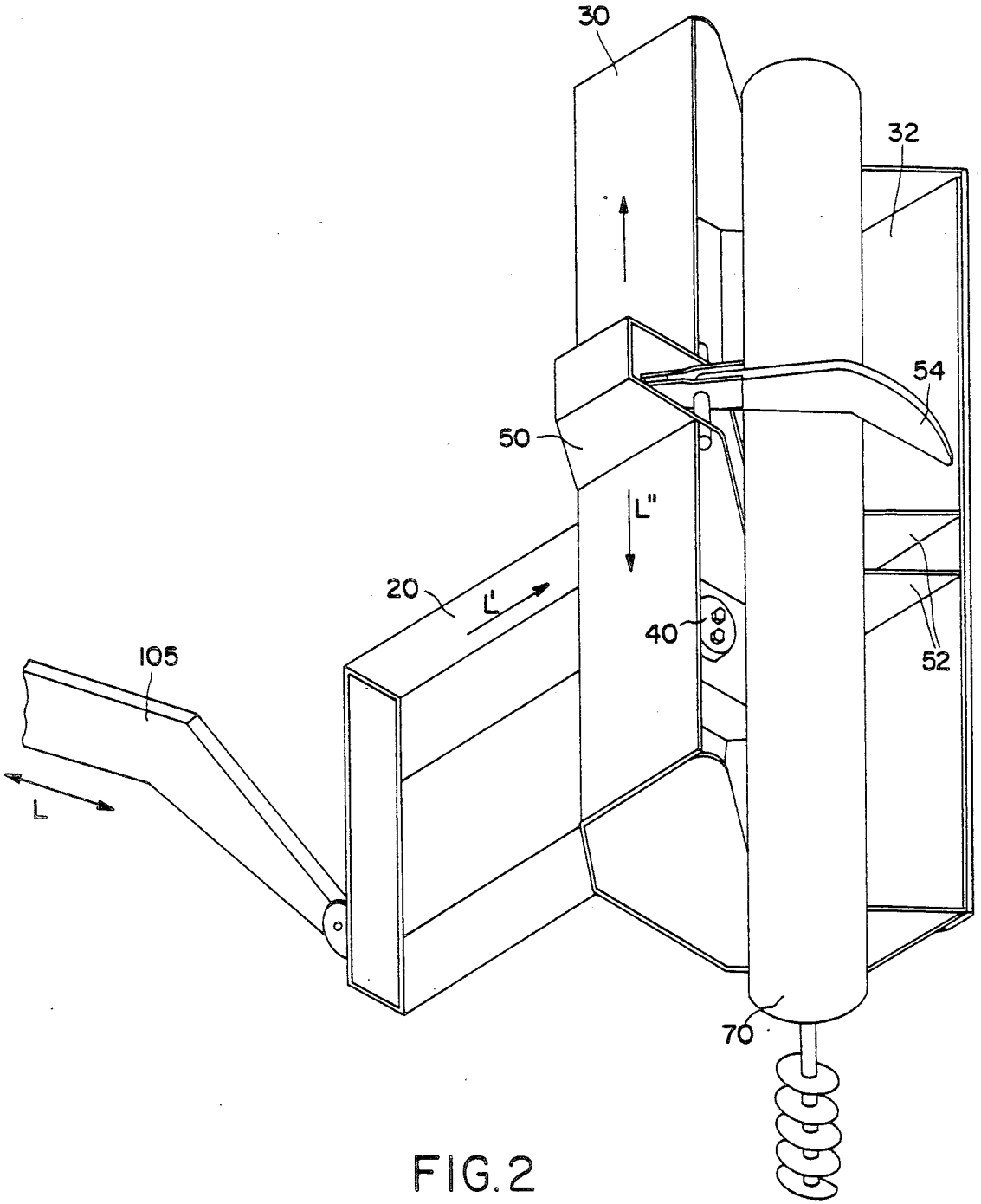
FIG. 2 is a perspective view of the attachment in a second mode.

Referring now to FIG. 2 which shows the attachment in a second working mode, the bucket 30 is slewed around the single large pivot pin 40 through 90 degrees relative to the first mode. Located within the bucket 30 is a grapple 50. This grapple 50 includes two fixed grapple fingers 52 and a movable finger 54 between the fingers 52. The movable finger 54 is operated by a hydraulic ram (not shown in FIG. 2). Using the grapple 50 elongate, circular or square cross sectional objects, such as poles, posts or lamp standards can be picked from the horizontal and slewed to a vertical position. Likewise, elongate objects in a vertical position can be grappled and placed in a horizontal position on the ground or on trailers, trucks and the like.

FIG. 2 also illustrates how the attachment may be used as a tool holder. An auger device 70 is held by the grapple 50 and the bucket 30 is slewed through 90 degrees using hydraulic ram 25 connected between rear mounting frame 20 and pivot pin 82. Hydraulic ram 25 and pivot pin 82 can be more clearly seen in FIG. 5. The auger device 70 is operated hydraulically from the prime mover. (The hydraulic hoses are not shown in the drawings).

Figure 3:
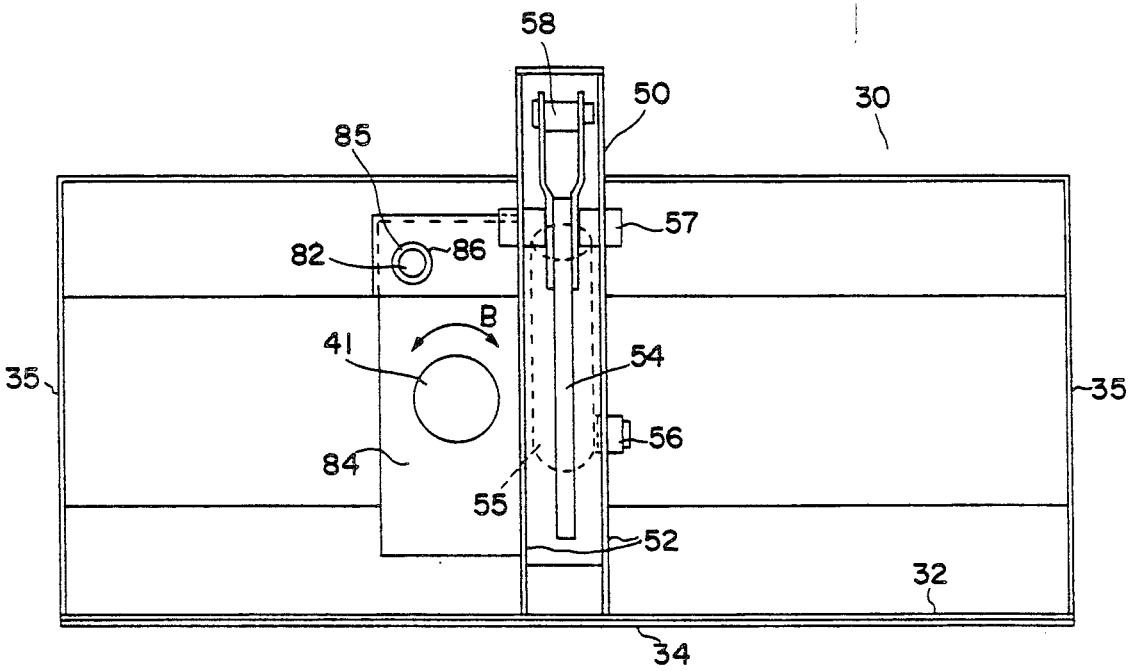
FIG. 3 is a front elevation of the attachment.
Figure 5:
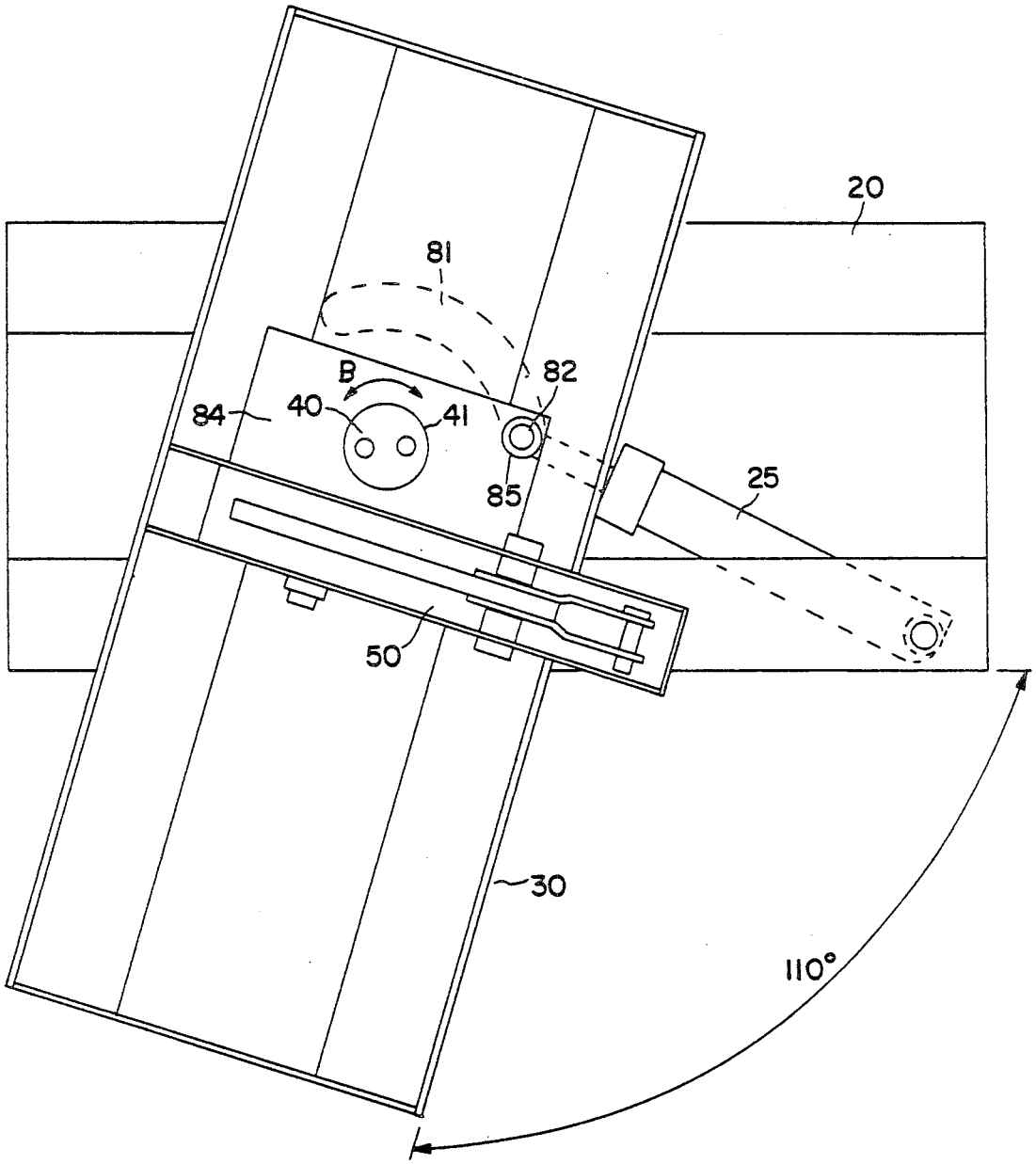
FIG. 5 is a front elevation of the attachment showing the maximum slew of the multi-purpose bucket of the attachment.

The multi-purpose bucket 30 is moved relative to the mounting frame 20 by a double acting hydraulic ram 25 (as shown in FIG. 5) and the finger 54 of the grapple 50 is moved by a hydraulic ram 55 (as shown in FIG. 3). The hydraulic fluid is taken from an auxiliary valve of the hydraulic system of the prime mover.

Figure 4A:
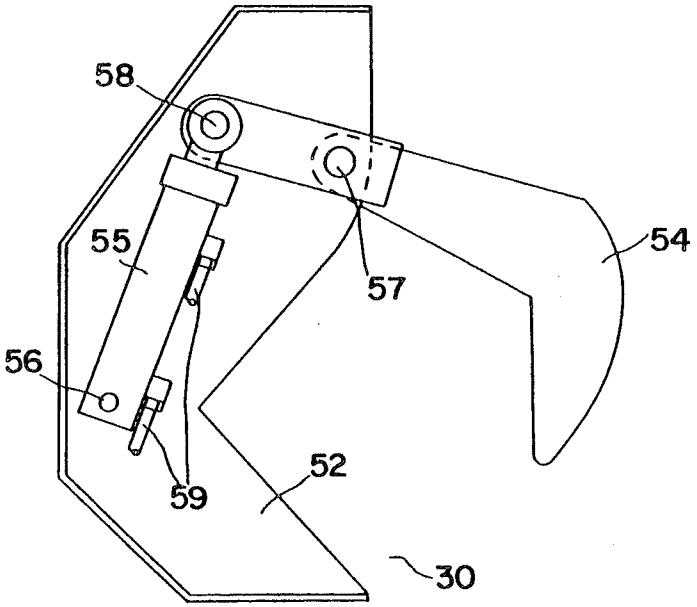
FIG. 4*a* is a sectional side elevation taken along line A—A' of FIG. 3 showing the grapple arrangement in an open position.
Figure 4:
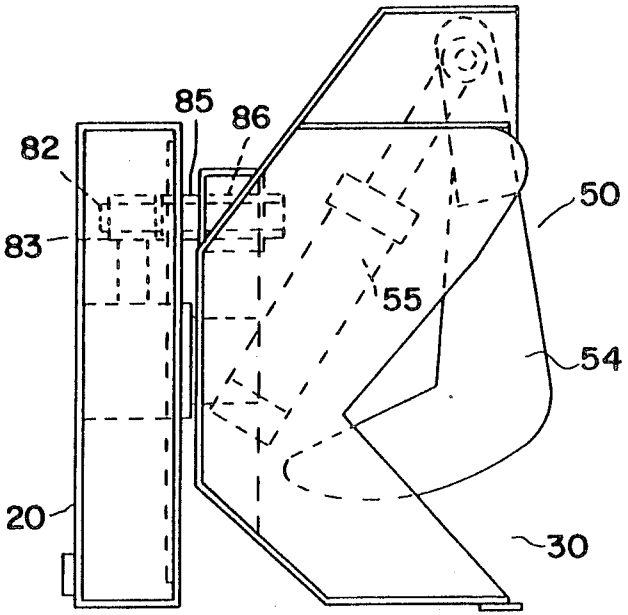
FIG. 4 is a side elevation of the attachment of FIG. 3, showing a grapple in a closed position.

FIGS. 3, 4 and 4*a* show in detail the grapple 50 and the positions of the components. The grapple 50 is centrally located in the bucket 30 and is operated by a hydraulic ram 55 having hydraulic connections 59 and is secured pivotally by a bolt arrangement 56 located between and attached to the two fixed grapple fingers 52. The upper telescopic section of the ram 55 is connected directly to the movable grapple finger 54 which is levered about pivot pin 57.

Figure 6:
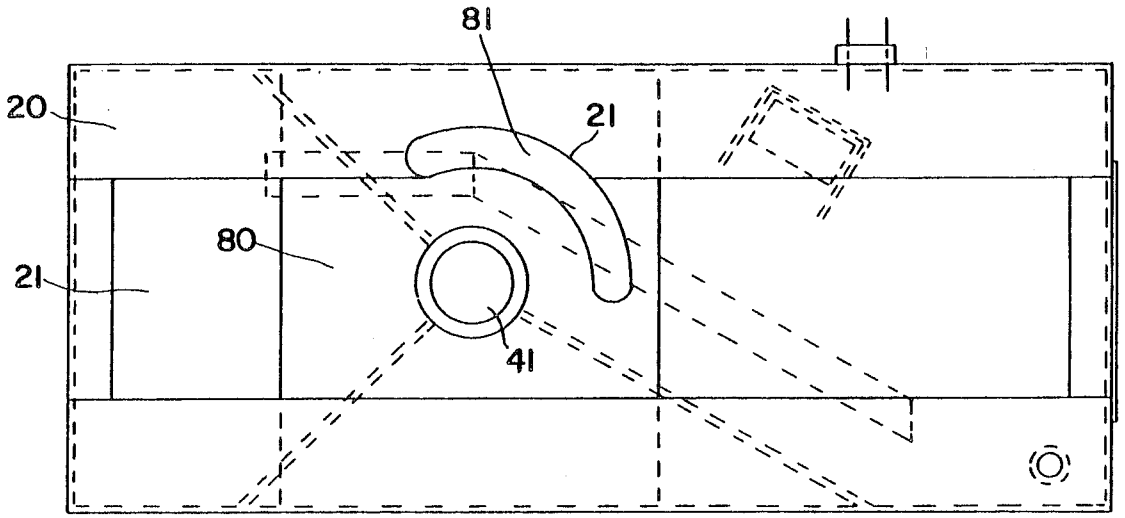
FIG. 6, 6*a* and 6*b* are two front elevations and a plan view of the rear mounting frame with slew plate respectively.

The bucket 30 is rotatably attached to the rear frame 20 by a single large pivot pin 40 which protrudes through pivot hole 41 in a slew plate 80 (as shown in FIG. 6).

FIG. 5 illustrates how the maximum slew of 110 degrees of the bucket 30 may be achieved using the double acting hydraulic ram 25 and slew plate 80 (as shown in FIG. 6) which is attached to the support frame 20 and pivot pin 82 which in turn is connected to a plate 84 which is attached to the bucket 30. The bucket 30 slews about the large pivot pin 40 and rotation is limited by the pivot pin 82 which is slidably engagable in an arcuate groove 81 in the slew plate 80.

Figure 6B:
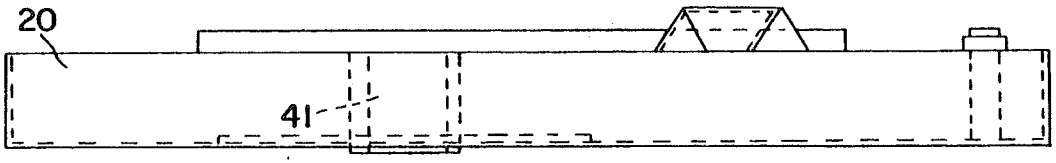
Figure 6A:
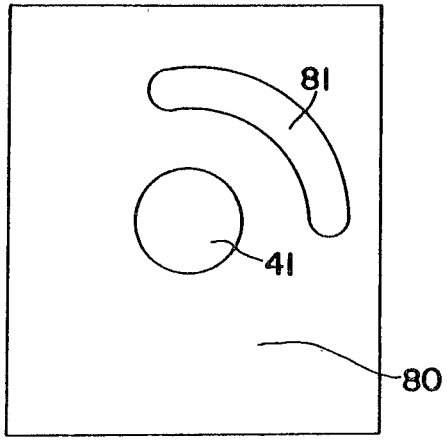

FIG. 6, 6*a* and 6*b* illustrate the position of the slew plate 80 on the rear mounting frame 20 and detail the position of the cut-away portion 21 with respect to the groove 81 in the slew plate 80.

Figure 7:
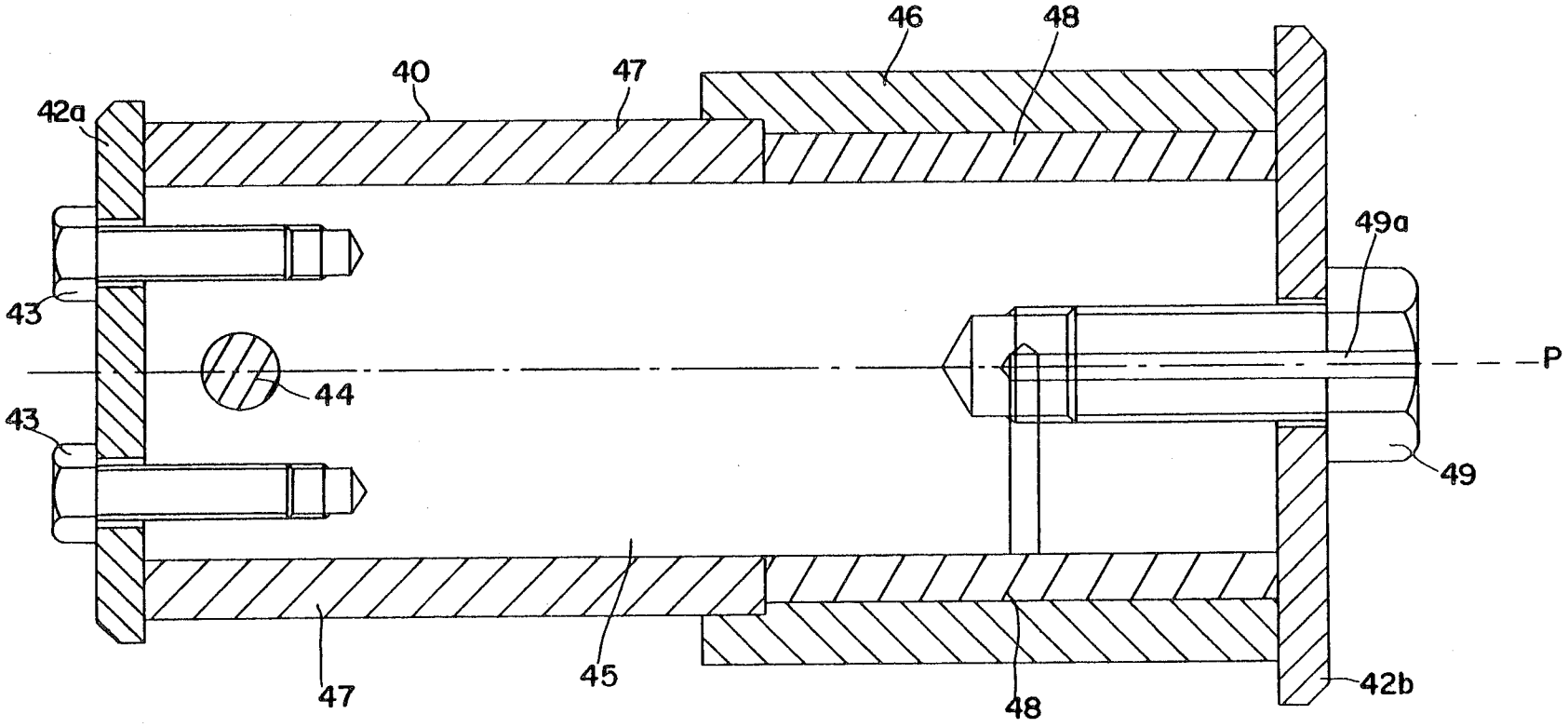
FIG. 7 is a sectional view of a single large pivot pin located between the bucket and the support frame.

In FIG. 7, the single large pivot pin 40 is shown in detail. A first end plate 42*a* engages plate 84 (not shown) in the bucket 30 and is held by two bolts 43 and a retainer pin 45 in the central shaft 44. The body of the pivot pin 40 comprises central shaft 45, a large housing 46, a small housing 47 and a bushing 48. A second end plate 42*b* engages the slew plate 80 (not shown) and is held by a relatively larger bolt 49 which has an integral grease hole 49*a*.

Figure 8A:
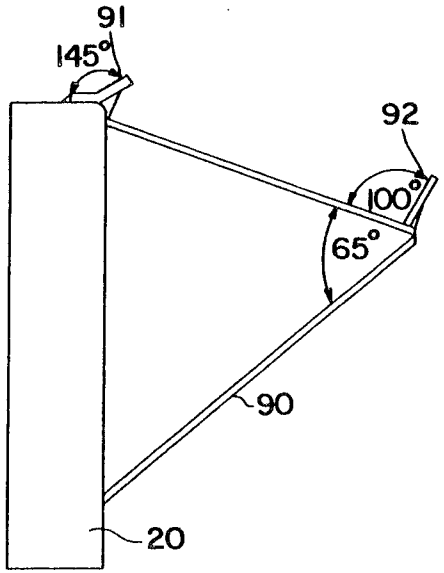
FIG. 8 and 8*a* are a front elevation, a side elevation of a quick-hitch system respectively for connecting the attachment to a prime mover.
Figure 8:
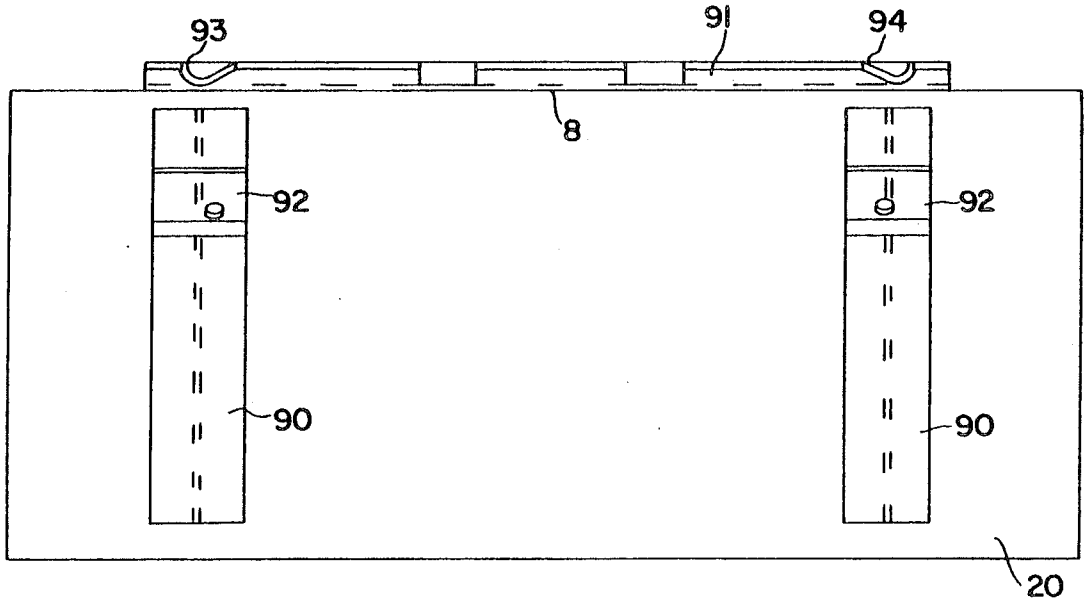

Finally, referring to FIGS. 8 and 8*a* a quick-hitch system is shown which is provided at the rear of support frame 20. It includes two quick-connectors 90 which engage the loader arms of the prime mover (not shown). Also provided are retaining means 91 and 92. Retaining means 91 is a shaped elongate piece which is bent along line 8 and has shaped indentations 93 and 94.

The attachment may be used to support tools such as log splitters, barrel clamps, power saws, pole clamps, pallet forks, cable drum clamps, lawn mowers, and the like. These tools can be fitted on either the top or bottom of the bucket 30 or may be held by the grapple 50. Due to the versatility of the movements which can be achieved with the bucket 30 and by raising and lowering the arms 105, the particular tool may be manoeuvred quite deftly.

Although, the above embodiment is operated by hydraulic power, the attachment may also be operated by pneumatic or electrical power or by any other suitable power source.

The hydraulic hoses which operate the attachment are provided with pipe rupture valves (not shown in the drawings) which in the event of hydraulic failure, such as for example, a pipe bursting, the grapple 50 is locked in its present position so that any load held by the grapple 50 will not be released.

We claim:

1. A versatile attachment adapted for mounting on lifting arms of a prime mover comprising in combination;

a frame having a front face, a rear face and pivotal mounting means on the rear face of said frame for pivotally mounting said frame on the lifting arms about a pivotal axis in the plane of an axis which is transverse to the longitudinal axes of the lifting arms;

a loading bucket having a depth which is so dimensioned that said loading bucket is adapted for handling loose materials;

slewing means for securing said loading bucket on said front face of said frame, said slewing means being operable to slew said loading bucket laterally relative to said frame about a slewing plane which is perpendicular to the pivotal axis of said frame from 0° to at least 90°, wherein 0° corresponds to a relative position between said bucket and said frame wherein the longitudinal axes of said bucket and said frame are parallel and wherein 90° corresponds to a relative position between said bucket and said frame wherein the longitudinal axes of said bucket and said frame are perpendicular to one another, said slewing means having a slewing axis which is offset relative to the center of the bucket and intersects the longitudinal axis of said bucket;

grappling means mounted on said loading bucket and movable therewith, said grappling means comprising at least one fixed grapple member located within said loading bucket and at least one movable grapple member which is operable by a hydraulic ram, said fixed and movable members being adapted for clamping an elongate element therebetween; and whereby said versatile attachment is adapted for handling both loose material and elongate members, such as poles, tools, and the like.

2. An attachment according to claim 1, wherein said slewing means is operable to slew said loading bucket laterally relative to said frame from 0° to about 110°.

3. An attachment according to claim 1, wherein said slewing means for securing said loading bucket on said front face of said frame comprises a rotatable shaft and a hydraulic ram for pivoting said loading bucket laterally relative to said frame about said shaft.

4. An attachment according to claim 1, wherein a support means for an elongate element is provided at each end of said loading bucket and said grappling means is provided intermediate said ends.

5. An attachment according to claim 1, further including quick coupling means provided on said rear face of said frame which enables the attachment to be connected and disconnected to the lifting arms of the prime mover.

* * * * *